United States Patent [19]

Brede et al.

[11] Patent Number: 4,492,167

[45] Date of Patent: Jan. 8, 1985

[54] PARTIALLY COMBUSTIBLE PROPELLANT CHARGE IGNITER

[75] Inventors: Uwe Brede, Fürth; Alfred Hörr, Zirndorf; Horst Penner, Fürth, all of Fed. Rep. of Germany

[73] Assignee: Dynamit Nobel Aktiengesellschaft, Troisdorf, Fed. Rep. of Germany

[21] Appl. No.: 496,256

[22] Filed: May 19, 1983

[30] Foreign Application Priority Data

Jul. 14, 1982 [DE] Fed. Rep. of Germany ..... 3226269

[51] Int. Cl.[3] ..... F42B 9/08

[52] U.S. Cl. ..... 102/470; 102/204

[58] Field of Search ..... 102/469, 470, 471, 472, 102/417, 204, 430, 202, 203

[56] References Cited

U.S. PATENT DOCUMENTS

| | | | |
|---|---|---|---|
| 3,392,673 | 7/1968 | King | 102/202 |

FOREIGN PATENT DOCUMENTS

| | | | |
|---|---|---|---|
| 2355255 | 5/1975 | Fed. Rep. of Germany | 102/472 |
| 2553717 | 6/1976 | Fed. Rep. of Germany | 102/470 |
| 2343987 | 10/1977 | France | 102/470 |
| 510812 | 4/1957 | Italy | 102/430 |
| 605135 | 7/1948 | United Kingdom | 102/204 |

*Primary Examiner*—Harold J. Tudor
*Assistant Examiner*—Tyrone Davis
*Attorney, Agent, or Firm*—Antonelli, Terry & Wands

[57] ABSTRACT

A partially combustible propellant charge igniter in which combustible ignition-conducting tubes can be more advantageously separated. The igniter includes a metallic bottom piece accommodating an igniter charge therein, a centrally arranged ignition gas guide chamber in communication with the igniter charge for guiding ignition gas therefrom and a combustible ignition-conducting tube accommodating a propagation charge. The ignition-conducting tube is inserted into the bottom piece and extends outwardly therefrom with the propagation charge being arranged in the region of the ignition-conducting tube which extends outwardly from the bottom piece. The igniter includes at least one cavity accommodating a separating charge and being at least partially delimited by a wall of the ignition gas guide chamber and the ignition-conducting tube inserted in the bottom piece, and a nozzle for establishing a communicating connection of the cavity to the portion of the ignition-conducting tube accommodating the propagation charge. The nozzle enables the escape of gases produced by the separating charge after ignition of the separating charge.

20 Claims, 4 Drawing Figures

PARTIALLY COMBUSTIBLE PROPELLANT CHARGE IGNITER

The present invention relates to propellant charge igniters having a combustible ignition-conducting tube which tube is inserted in a metallic bottom piece. The metallic bottom piece which may optionally be multipartite surrounds an igniter charge and an adjoining, centrally arranged separating gas guide chamber terminating into the inner space of the ignition-conducting tube. A propagation charge is disposed in the ignition-conducting tube which charge ignites a primary charge arranged around the ignition-conducting tube.

In these conventional propellant charge igniters, the combustible ignition-conducting tube is frequently combusted only to an inadequate extent, and adheres to the bottom piece. However, such an incomplete combustion of the ignition-conducting tube is undesirable.

It is, therefore, an object of the present invention to provide a propellant charge igniter of the above-mentioned construction wherein the ignition-conducting tubes are maximally completely combusted and are separated from the bottom piece.

In accordance with the present invention a propellant charge igniter includes a metallic bottom piece which may optionally be multi-partite and encompasses an igniter charge and a centrally arranged ignition gas guide chamber, a combustible ignition-conducting tube containing a propellant charge inserted into the bottom piece so as to adjoin the bottom piece, the diameter of the ignition-conducting tube being larger than the diameter of the ignition gas guide chamber, and at least one cavity containing a separating powder charge is disposed between a wall of the ignition gas chamber and the ignition-conducting tube, a communicating connection of the cavity to the portion of the ignition-conducting tube containing the propagating charge being constructed as a nozzle for the escape of gases produced by the separating powder charge after ignition thereof.

According to a feature of the present invention, the cavity is partially or entirely delimited by the combustible ignition-conducting tube along one of its longitudinal sides. It is unnecessary in accordance with the invention to insert the ignition-conducting tube in the bottom piece up to the base of this cavity, it merely being essential that the tube constitutes the lateral boundary for the cavity at least up to the upper rim of the nozzle.

If the ignition-conducting tube is inserted up to the base of the cavity in the bottom piece, it is advantageous to cover the tube with a metallic wall facing toward the cavity. This can prevent an undesirable smoldering of the portion of the ignition-conducting tube inserted in the bottom piece.

The cavity is furthermore configured so that the gases evolving therein by combustion of the separating charge located in this cavity can exit through the nozzle. Therefore, in a preferred embodiment of the present invention, the cavity has a more or less extensive beveling toward the nozzle. The angle of this bevel depends on the flow-dynamic properties, such as, for example, pressure, temperature, velocity, and viscosity of the combustion gases of the separating charge. This angle is preferable between 40° and 50°.

The nozzle according to a further feature of the present invention is preferably of an annular shape. Its slow width, which likewise depends on the above-mentioned flow-dynamic properties of the combustion gases produced by the separating charge located in the cavity, is preferably between 0.2 and 0.7 mm.

In accordance with another feature of the present invention, the portion of the bottom piece located between the cavity and the ignition gas guide chamber can also be anchored in the bottom piece as a separate, prefabricated component. In such a case, this component is provided in the form of a tube, the inner diameter of which corresponds to the desired diameter of the ignition gas guide chamber. The tube end in this case is fashioned as a collar wherein the end piece of the collar forms the bottom edge of the nozzle. The geometrical form of the collar end then also determines the geometrical shape of the nozzle, the form of the collar being preferably hexagonal. The material of such a tube can be different from the material of the bottom piece. Optionally, the tube material can also be a combustible material.

The separating charge located in the cavity is a powder known per se, for example, based on nitrocellulose or gunpowder or a boron/potassium nitrate powder, or mixtures of these components. According to a feature of the present invention, the powder is preferably in pill shape and fills the cavity partially or entirely. If the cavity, in a preferred embodiment of the invention, is fashioned as a ring-shaped cavity, then it is advantageous also to use the separating charge pills as annular tablets.

In accordance with the present invention, the temporal course of the combustion of the separating charge pill can be controlled by the composition of the charge, especially the pill which is directly at the nozzle, in that delay charges are provided. Preferably, the pill located closest to the nozzle contains such a conventional delay charge.

To provide improved ignition throughout, an advantageous embodiment of the present invention furthermore includes an additional gas-absorbing volume or chamber arranged adjacent to—i.e., below—the cavity containing the separating charge powder. At that location of additional gas-absorbing chamber, the ignition gases flowing from the outside through the annular nozzle are initially accumulated. The ignition of the separating charge can thereby be improved.

The construction of the propellant charge igniter according to the present invention has the effect that the ignition-conducting tube in the zone of the nozzle is under especially strong attack mechanically and thermally, so that complete combustion or separation of this tube occurs at that location. Accordingly, the present arrangement overcomes the drawback of the prior arrangements.

These and further objects, features and advantages of the present invention will become more apparent from the following description when taken in connection with the accompanying drawings which show, for purposes of illustration only, several embodiments in accordance with the present invention, and wherein.

Figure 1:
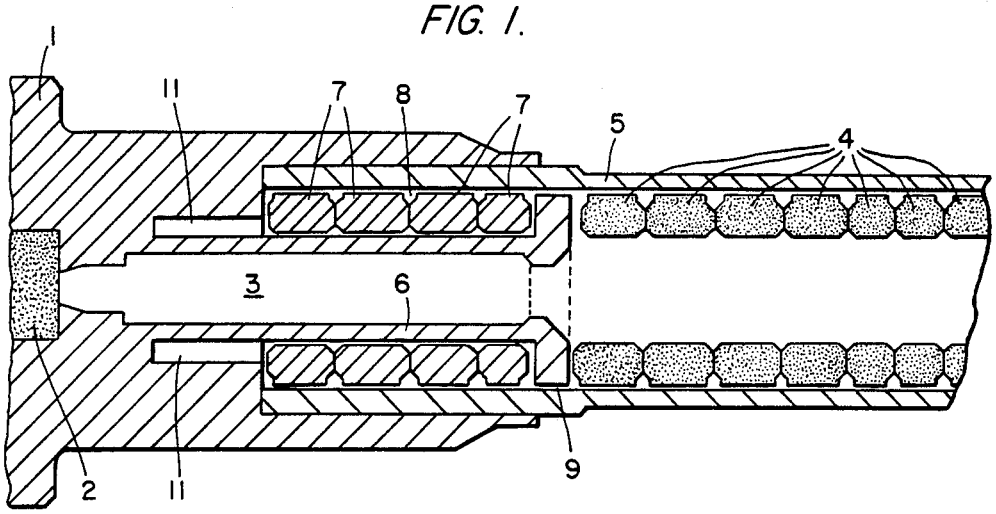
FIG. 1 is a sectional view of a part of an ignition member of a propellant charge igniter in accordance with the present invention.

Referring now to the drawings wherein like reference numerals are utilized to designate like parts throughout the several views, FIG. 1 is a sectional view of a part of the ignition member including a bottom piece 1 in which the ignition-conducting tube 5 is inserted. An igniter charge 2, which can be ignited, for example, by an electric primer, not shown herein, is arranged in the bottom portion of the bottom piece 1 in a central location. The bottom piece surrounds a centrally disposed ignition gas guide chamber and, together with the lower portion of the ignition-conducting tube 5, also surrounds a cavity 8, which cavity is formed as a high-pressure chamber. The high-pressure chamber contains annular separating charge pills 7. An annular nozzle 9 forms a communicating connection of the high-pressure chamber 8 with the space formed by the ignition-conducting tube 5 where a propagation charge 4 is located in the form of a pill column. Furthermore, a gas-absorbing volume chamber 11 is provided below the separating charge 7 to provide improved through-flow through the annular pills thereof during ignition.

Figure 2:
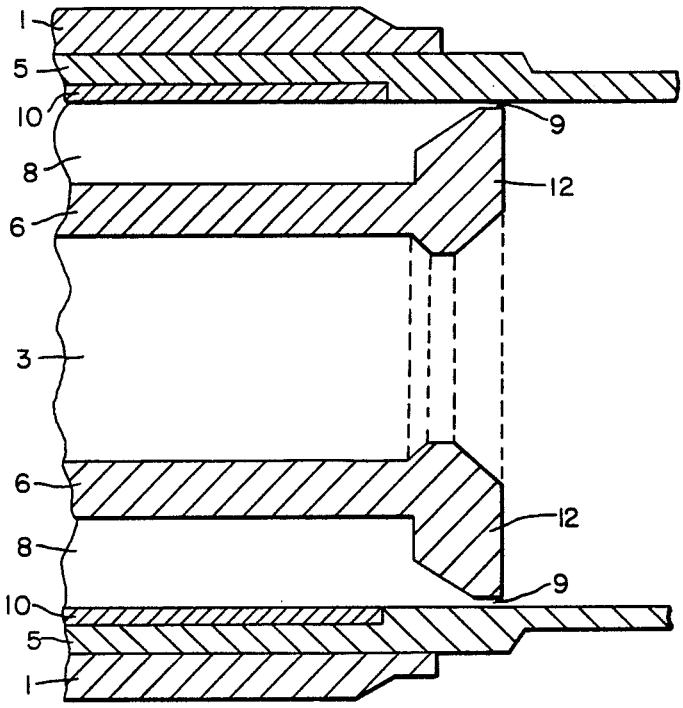
FIG. 2 is a sectional view of a part of the ignition member of the propellant charge igniter illustrating the nozzle area and surrounding region in greater detail.

FIG. 2 shows, in detail, a preferred embodiment in the zone of the cavity 8 and the nozzle 9. As shown, the wall of the cavity 8 is at least partially delimited by the ignition-conducting tube 5 and is covered with respect to the ignition-conducting tube 5 by a metallic wall 10. This metallic wall can also cover merely a part of the ignition-conducting tube, or it can also be extended up to the nozzle. Furthermore, the inner portion of the wall of the cavity is formed as a tube 6 exhibiting a collar 12 extending towards the ignition-conducting tube. The collar 12 is furthermore formed so that its end section has a bevel of preferably between 40° and 50° and shown as about 45° toward the annular nozzle 9 with the nozzle having a slot width preferably between 0.2 and 0.7 mm. For the sake of clarity, this figure does not show the separating charges 7 and the propagation charges 4.

Figure 3:
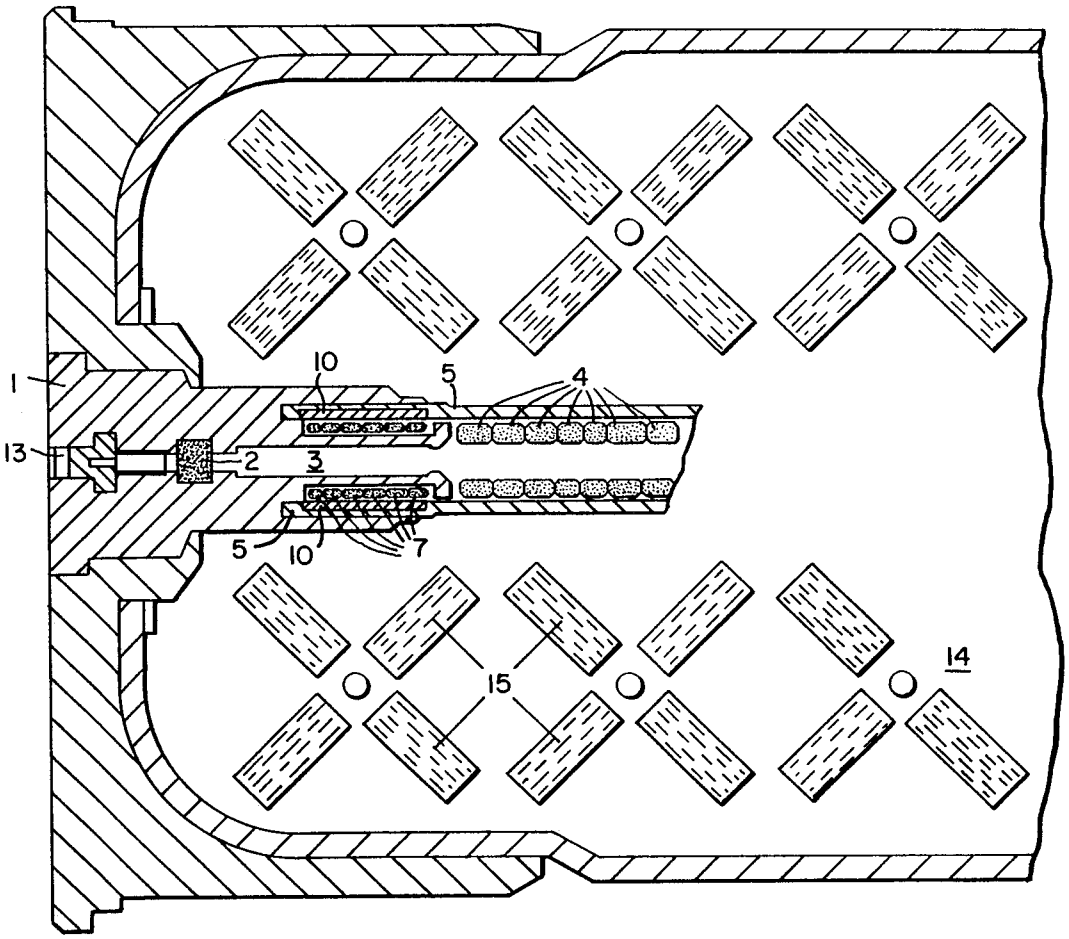
FIG. 3 is a sectional view of the propellant charge igniter disposed in a cartridge.

FIG. 3 illustrates the mode of operation of the arrangement according to the invention in a propellant charge igniter disposed in a cartridge. The propellant charge igniter is provided with a pole piece 13. Once the voltage has been applied to the pole piece, the igniter charge 2 ignites. The ignition jet of this charge is conducted through the ignition gas guide chamber 3 to the pill column 4 and ignites the pill column. Due to the burning pill column 4, the annular pills 7 arranged in the cavity 8 are ignited with a time delay. Depending upon the condition of the already building-up ambient pressure in the entire cartridge case, a pressure difference arises between the cavity 8 and the pressure chamber 14 which lies outside of the ignition-conducting tube 5. In the chamber 14, a primary charge 15 is provided which is also ignited by the pill column 4 via bores (not shown herein) through the ignition-conducting tube 5.

Depending upon the properties of the combustion process of the primary charge 15, the separation of the ignition tube in the zone of the nozzle can be adjusted temporally as well as with respect to intensity, by an appropriate choice of the composition of the annular pills 7 and by a controlled optimization of the slot of the nozzle 9 with regard to width and geometrical shape, for example.

Figure 4:
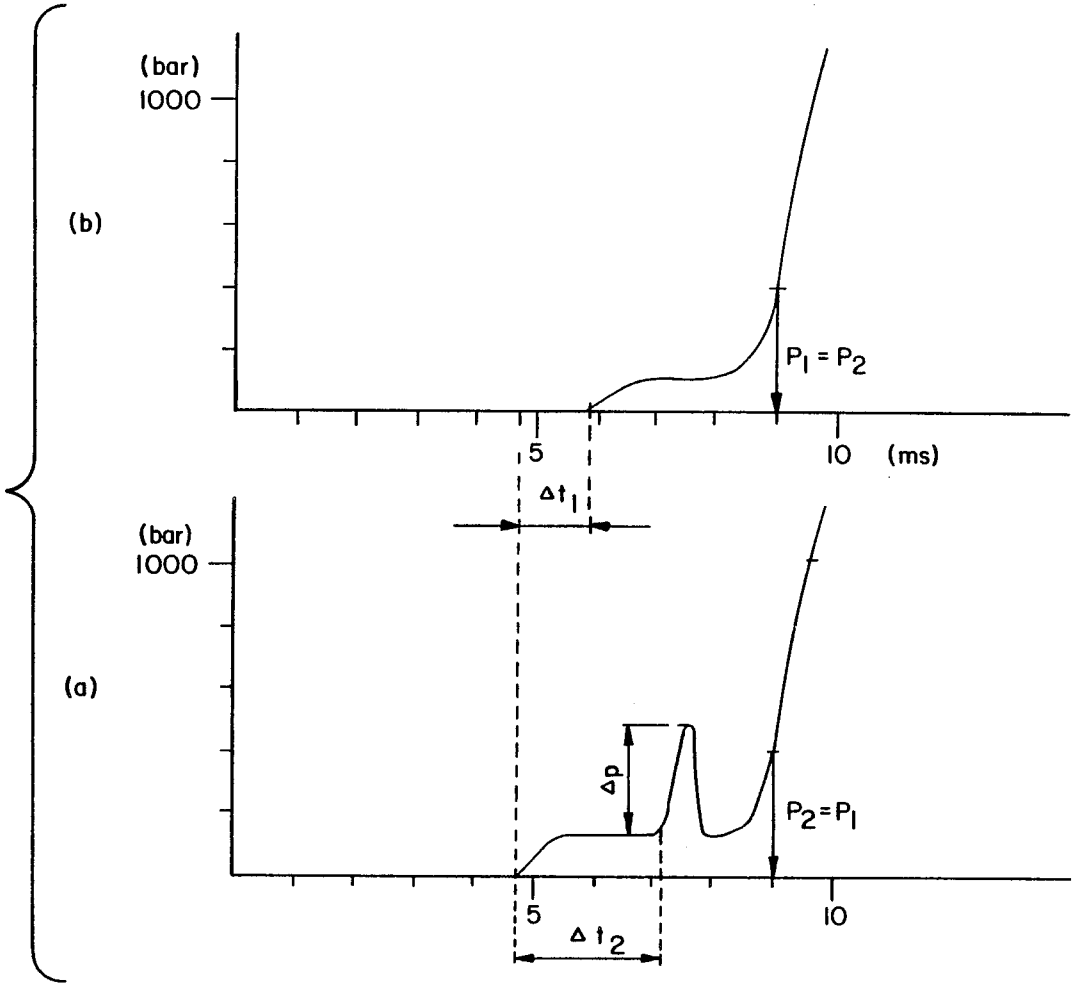
FIG. 4 shows graphs illustrating the chronological pressure curve in the high pressure chamber of the propellant charge igniter and in the propellant charge chamber.

FIG. 4 shows the chronological pressure curve in the high-pressure chamber 8 of the propellant charge igniter (a) and in the propellant charge powder chamber (b). After ignition of the propellant charge igniter, the same pressure initially arises in the high-pressure chamber 8 as in the whole interior constituted by the ignition-conducting tube 5. Only after a time delay $\Delta_{t2}$ are the pills 7 ignited which are located in the high-pressure chamber 8. Depending on the type of composition of the pills, a high-pressure surge $\Delta_p$ is produced, leading to a strong, sudden efflux of the combustion products through the annular nozzle 9. The combustible tube 5 is weakened at this location and supported in its combustion by the progressive reaction of the propellant charge powder, and thus is separated. The pressure curve within the high-pressure chamber of the propellant charge igniter and in the propellant charge powder chamber then exhibits the same temporal course, $P_1=P_2$, or $P_2=P_1$.

While we have shown and described several embodiments in accordance with the present invention, it is understood that the same is not limited thereto but is susceptible of numerous changes and modifications as known to one having ordinary skill in the art and we therefore do not wish to be limited to the details shown and described herein, but intend to cover all such modifications as are encompassed by the scope of the appended claims.

We claim:

1. A partially combustible propellant charge igniter comprising a metallic bottom piece accommodating an igniter charge therein, a centrally arranged ignition gas guide chamber in communication with the igniter charge for guiding ignition gas therefrom, a combustible ignition-conducting tube accommodating a propagation charge, the ignition-conducting tube being inserted into the bottom piece and extending outwardly therefrom, the propagation charge being arranged in the region of the ignition-conducting tube extending outwardly from the bottom piece, at least one cavity accommodating a separating charge and being at least partially delimited by a wall of the ignition gas guide chamber and the ignition-conducting tube portion inserted in the bottom piece, and nozzle means for establishing a communicating connection of the cavity to the portion of the ignition-conducting tube accommodating the propagation charge, the nozzle means enabling the escape of gases produced by the separating charge after ignition of the separating charge.

2. A partially combustible propellant charge igniter according to claim 1, wherein the ignition gas guide chamber is provided with a first diameter and the ignition-conducting tube is provided with a second diameter, the second diameter being larger than the first diameter.

3. A partially combustible propellant charge igniter according to claim 1, wherein a metal plate is provided adjacent the ignition-conducting tube in the region of the cavity and facing the interior of the cavity.

4. A propellant charge igniter according to claim 1, wherein the nozzle means has a width between 0.2 and 0.7 mm.

5. A partially combustible propellant charge igniter according to claim 1, wherein the cavity is configured as an annular hollow chamber.

6. A partially combustible propellant charge igniter according to claim 5, wherein the separating charge accommodated in the cavity is configured as annular pill members.

7. A partially combustible propellant charge igniter according to claim 5, wherein the nozzle means is configured as an annular nozzle.

8. A partially combustible propellant charge igniter according to claim 7, wherein the nozzle has a width between 0.2 and 0.7 mm.

9. A partially combustible propellant charge igniter according to claim 1, wherein the cavity is provided with a wall portion having a bevel extending in the direction of the nozzle means.

10. A partially combustible propellant charge igniter according to claim 9, wherein the angle of the bevel of the wall portion is 45°.

11. A partially combustible propellant charge igniter according to claim 1, wherein the wall of the ignition gas guide chamber delimiting a portion of the cavity is configured as a tube centrally disposed in the bottom piece, the tube having an outwardly projecting collar extending in the direction of the ignition-conduting tube.

12. A partially combustible propellant charge igniter according to claim 1, wherein a gas-absorbing chamber is provided adjacent to the cavity, the gas-absorbing chamber enabling improved throughflow through the separating charge in the cavity.

13. A partially combustible propellant charge igniter according to claim 1, wherein the metallic bottom piece is multipartite.

14. A partially combustible propellant charge igniter according to claim 8, wherein the cavity is provided with a wall portion having a bevel extending in the direction of the nozzle.

15. A partially combustible propellant charge igniter according to claim 14, wherein the angle of the bevel of the wall portion is between 40° and 50°.

16. A partially combustible propellant charge igniter according to claim 15, wherein the separating charge accommodated in the cavity is configured as annular pill members.

17. A partially combustible propellant charge igniter according to claim 16, wherein at least one of the pill members adjacent to the nozzle includes delay means.

18. A partially combustible propellant charge igniter according to claim 17, wherein a metal plate is provided adjacent the ignition-conducting tube in the region of the cavity and facing the interior of the cavity.

19. A partially combustible propellant charge igniter according to claim 18, wherein a gas-absorbing chamber is provided adjacent to the cavity at a position away from the nozzle, the gas-absorbing chamber enabling improved throughflow through the separating charge.

20. A partially combustible propellant charge igniter according to claim 19, wherein the wall of the ignition guide chamber delimiting a portion of the cavity is configured as a tube centrally disposed in the bottom piece, the tube having an outwardly projecting collar extending in the direction of the ignition-conducting tube for forming at least a part of the nozzle.

* * * * *